US012220093B1

(12) United States Patent
He

(10) Patent No.: US 12,220,093 B1
(45) Date of Patent: Feb. 11, 2025

(54) FOLDING BATH BUCKET

(71) Applicant: Zhecheng He, Anqing (CN)

(72) Inventor: Zhecheng He, Anqing (CN)

(73) Assignee: Jiangsu Chengxiu Precision Hardware and Plastic Products Co., Ltd., Huai 'an (CN)

( * ) Notice: Subject to any disclaimer, the term of this patent is extended or adjusted under 35 U.S.C. 154(b) by 0 days.

(21) Appl. No.: 18/788,182

(22) Filed: Jul. 30, 2024

(51) Int. Cl.
*A47K 3/06* (2006.01)

(52) U.S. Cl.
CPC ..... *A47K 3/06* (2013.01)

(58) Field of Classification Search
CPC ..... A47K 3/06; E04H 4/14
See application file for complete search history.

(56) References Cited

U.S. PATENT DOCUMENTS 1,765,074 A * 6/1930 Hooper ..... E04H 4/0056 4/506
2,062,316 A * 12/1936 Johnson ..... A47K 3/06 607/86
2019/0178275 A1* 6/2019 Lin ..... F16B 7/042
2022/0034113 A1* 2/2022 Huang ..... F16B 7/0406

FOREIGN PATENT DOCUMENTS

CN 111329370 A * 6/2020 ..... A47K 3/001

* cited by examiner

*Primary Examiner* — Christine J Skubinna

(57) ABSTRACT

A novel folding bath bucket includes a folding bracket and a water storage component. The water storage component is connected to the folding bracket for water storage. A connection frame is arranged at a top of the folding bracket. A chamber is formed inside the connection frame. The chamber forms a connection slot at a bottom of the connection frame. A connection portion is arranged at a top of the water storage component. The connection portion is clamped in the chamber through the connection slot to achieve the connection between the water storage component and the folding bracket. Through the above arrangement, the connection portion of the present disclosure is completely wrapped in the chamber inside the connection frame, avoiding damage caused by direct contact between the connection portion and the outside.

19 Claims, 8 Drawing Sheets

FOLDING BATH BUCKET

TECHNICAL FIELD

The present disclosure relates to the technical field of bath buckets, and in particular, to a novel folding bath bucket.

BACKGROUND OF THE INVENTION

A bath bucket is a commonly used container for taking a bath in daily life. The existing bath bucket usually has a large volume, which is not conducive to transportation, and needs to occupy a large space when not in use. In order to solve the above technical problems, a novel folding bath bucket has emerged on the market. When not in use, the novel folding bath bucket can be folded for storage, thereby reducing the space occupation and facilitating the transportation.

The existing folding bath bucket is generally composed of a supporting frame and a thermal insulation fabric. The thermal insulation fabric sleeves the supporting frame to form the bath bucket. Specifically, the supporting frame includes a base, a folding supporting pipe, and a bath bucket opening connection sleeve. The thermal insulation fabric sleeves the bath bucket opening connection sleeve; two ends of the folding supporting pipe are connected to the base and the bath bucket opening connection sleeve respectively; and the folding supporting pipe is folded to achieve the folding of the supporting frame.

It can be understood that the existing folding bath bucket have the following problems:

1. The thermal insulation fabric sleeves the bath bucket opening connection sleeve, which is easily worn to be damaged during use, and the service life of the folding bath bucket is reduced.
2. The base and the bath bucket opening connection sleeve cannot be folded for storage, so that a folded bucket body still occupies a large space.

SUMMARY OF THE INVENTION

The present disclosure aims to provide a novel folding bath bucket.

The novel folding bath bucket includes a folding bracket and a water storage component, wherein the water storage component is connected to the folding bracket for water storage; a connection frame is arranged at a top of the folding bracket; a chamber is formed inside the connection frame; the chamber forms a connection slot at a bottom of the connection frame; a connection portion is arranged at a top of the water storage component; and the connection portion is clamped in the chamber through the connection slot to achieve the connection between the water storage component and the folding bracket.

Further, the water storage component includes a bottom wall and a side wall; the side wall is arranged around the bottom wall to form a water storage space; and the connection portion protrudes out of a top of the side wall.

Further, a thickness of the side wall matches a width of the connection slot; and a cross-sectional diameter of the connection portion is greater than the width of the connection slot.

Further, limiting portions are formed on two sides of the connection portion; and the limiting portions resist against an inner wall of the chamber to achieve the clamping between the connection portion and the chamber.

Further, a partition plate is further arranged in the chamber; the partition plate divides the chamber into an upper chamber and a lower chamber; and the connection portion is clamped in the lower chamber.

Further, the connection frame includes several first sleeves and several first connectors; and adjacent first sleeves are connected end to end through the first connectors.

Further, first insertion portions are formed at two ends of the first connectors; first insertion ports are formed in the chamber at two ends of the first sleeves; and the first insertion portions are in inserted connection with the first insertion ports.

Further, insertion slots are further provided at two ends of the first connectors; the partition plate extends to the two ends of the first sleeves; and the partition plate is in inserted connection with the insertion slots.

Further, the connection portion includes several connection units; the connection units are connected to the first sleeves; and two adjacent connection units form a first avoidance opening at the first connector.

Further, the folding bracket further includes supporting rods and a bottom frame; lower ends of the supporting rods are detachably connected to the bottom frame; and upper ends of the supporting rods are detachably connected to the first connectors.

Further, the bottom frame includes several second sleeves and several second connectors; and adjacent second sleeves are connected end to end through the second connectors.

Further, second insertion portions are formed at two ends of the second connectors; second insertion ports are provided at two ends of the second sleeves; and the second insertion portions are in inserted connection with the second insertion ports.

Further, the folding bracket further includes several third connectors; and two ends of the supporting rods are respectively connected to the first connectors and the second connectors through the third connectors.

Further, a third insertion port is provided at one end of each third connector, and a protrusion is arranged at the other end; the first connectors and the second connectors include connection ports; the two ends of the supporting rods are respectively connected to the third insertion ports; and the protrusions are connected to the connection ports.

Further, first insertion units are arranged on two sides of the protrusions; second insertion units are correspondingly arranged on inner side walls of the connection ports; and the first insertion units are in inserted connection with the second insertion units.

Further, each supporting rod includes an upper supporting rod and a lower supporting rod; and a lower end of the upper supporting rod is in folded connection with an upper end of the lower supporting rod.

Further, each supporting rod further includes a first hinge piece and a second hinge piece; a lower supporting rod insertion port is provided at a lower end of the first hinge, and a first hinge portion is arranged at an upper end of the first hinge piece; a second hinge portion is arranged at a lower end of the second hinge, and an upper supporting rod insertion port is provided at an upper end of the second hinge piece; the upper supporting rod insertion port and the lower supporting rod insertion port are respectively connected to the upper supporting rod and the lower supporting rod; and the first hinge portion is hinged with the second hinge portion.

Further, the water storage component further includes a sleeving portion; the sleeving portion is arranged in an extension direction of the supporting rods to sleeve the supporting rods.

Further, the sleeving portion is provided with a second avoidance opening at a connection between the upper supporting rod and the lower supporting rod.

Further, the upper supporting rod has a length equal to a length of the lower supporting rod, and the length is $R_1$; a cross-sectional diameter of the folding bracket is $R_2$; and $R_1$ and $R_2$ satisfy the following relationship: $R_1 \leq R_2/2$.

Compared with the prior art, the present disclosure has the beneficial effects below: the chamber is arranged in the connection frame; the chamber is communicated to the outside through the connection slot at the bottom of the connection frame. To mount the water storage component, the side wall can be continuously inserted into the connection slot at one end of the connection frame to achieve sliding mounting of the connection portion in the chamber. Through the above arrangement, the connection portion of the present disclosure is completely wrapped in the chamber inside the connection frame, avoiding damage caused by direct contact between the connection portion and the outside. This solves the technical problem that "in the existing folding bath bucket, a thermal insulation fabric is easily damaged during use because it sleeves a bucket opening connection sleeve" and prolongs the service life of the folding bath bucket. Furthermore, the folding bath bucket has a simple structure and is convenient to mount.

Further, the folding bracket of the present disclosure can include the first sleeves, the second sleeves, the first connectors, the second connectors, the upper supporting rods, the lower supporting rods, the first hinge piece pieces, and the second hinge piece pieces, which greatly reduces the overall volume of the folding bracket, facilitates the assembling and disassembling, and solves the technical problem that "the existing folding bath bucket still occupies a large space after being folded".

BRIEF DESCRIPTION OF DRAWINGS

It is to be noted that embodiments in the present disclosure and features in the embodiments may be combined with each other without conflict.

In the description of the present disclosure, It is to be understood that, The terms "center", "longitudinal", "transverse", "upper", "lower", "front", "rear", "left", "right", "vertical", "horizontal", "top", "bottom", "inner", "outer", and the like indicate azimuth or positional relationships based on the azimuth or positional relationships shown in the drawings, For purposes of convenience only of describing the present disclosure and simplifying the description, Rather than indicating or implying that the indicated device or element must have a particular orientation, be constructed and operated in a particular orientation, therefore, not to be construed as limiting the present disclosure; in addition, The terms "first" and "second" are used for descriptive purposes only, While not to be construed as indicating or implying relative importance or implicitly specifying the number of technical features indicated thereby, features defining "first," "second," and "second" may explicitly or implicitly include one or more of the described features. In the description of the present disclosure, "multiple" means two or more unless explicitly specified otherwise.

In the description of the present disclosure, it is to be noted that unless otherwise expressly specified and defined, the terms "mounted", "connected", and "connected" are to be construed broadly, for example, as either a fixed connection, or a detachable connection, or an integral connection, either a mechanical connection, or an electrical connection. The specific meaning of the above term in the present disclosure will be understood by those of ordinary skill in the art depending on the particular circumstances, either directly or indirectly via an intermediate medium, communication between the two elements, or interaction between the two elements. The specific meanings of these terms in the present disclosure will be understood by those of ordinary skill in the art as the case may be.

The present disclosure will now be described below in detail with reference to the drawings and the embodiments.

Figure 1:
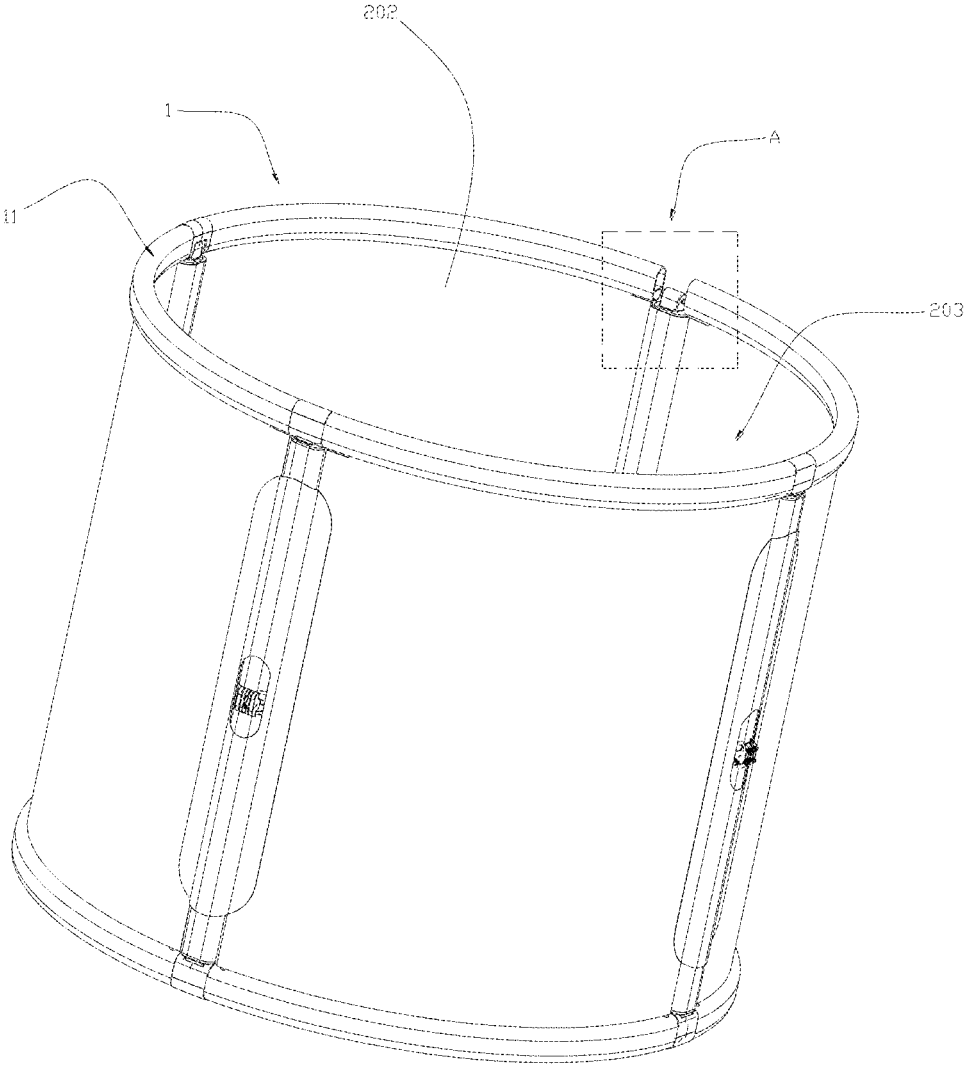
Figure 2:
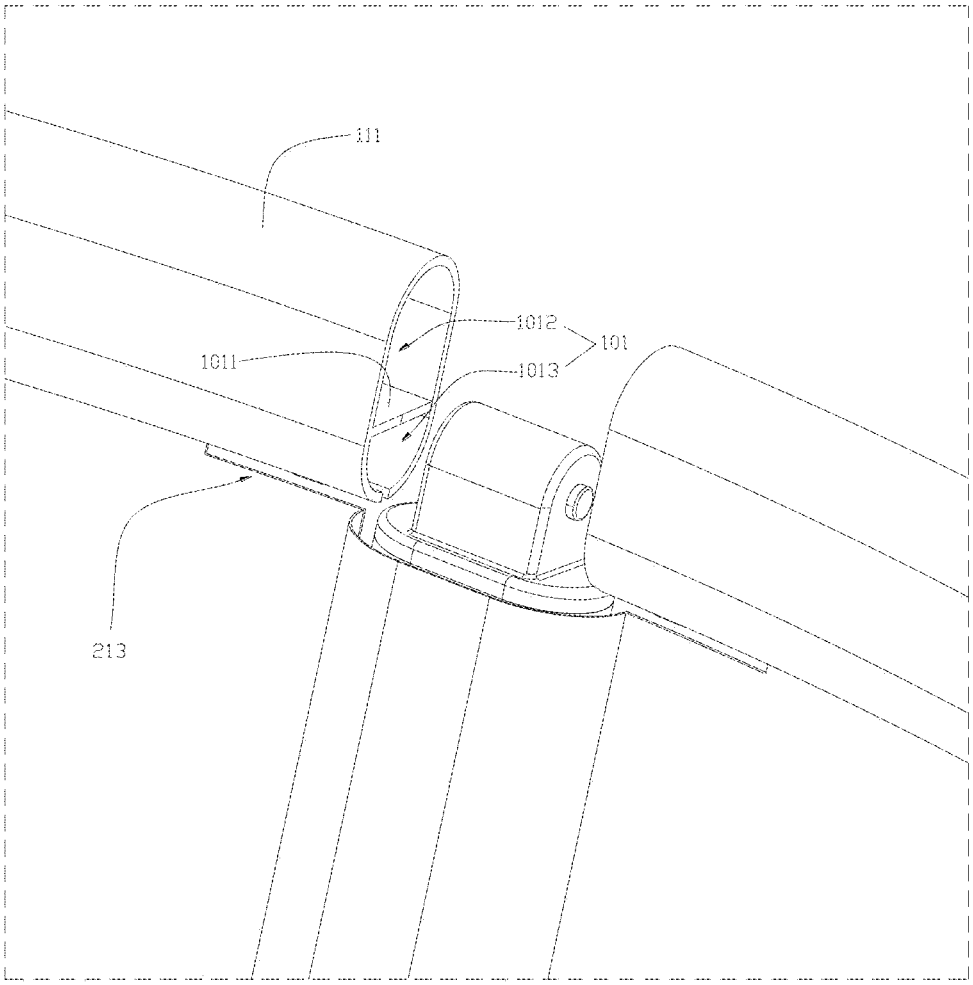
Figure 3:
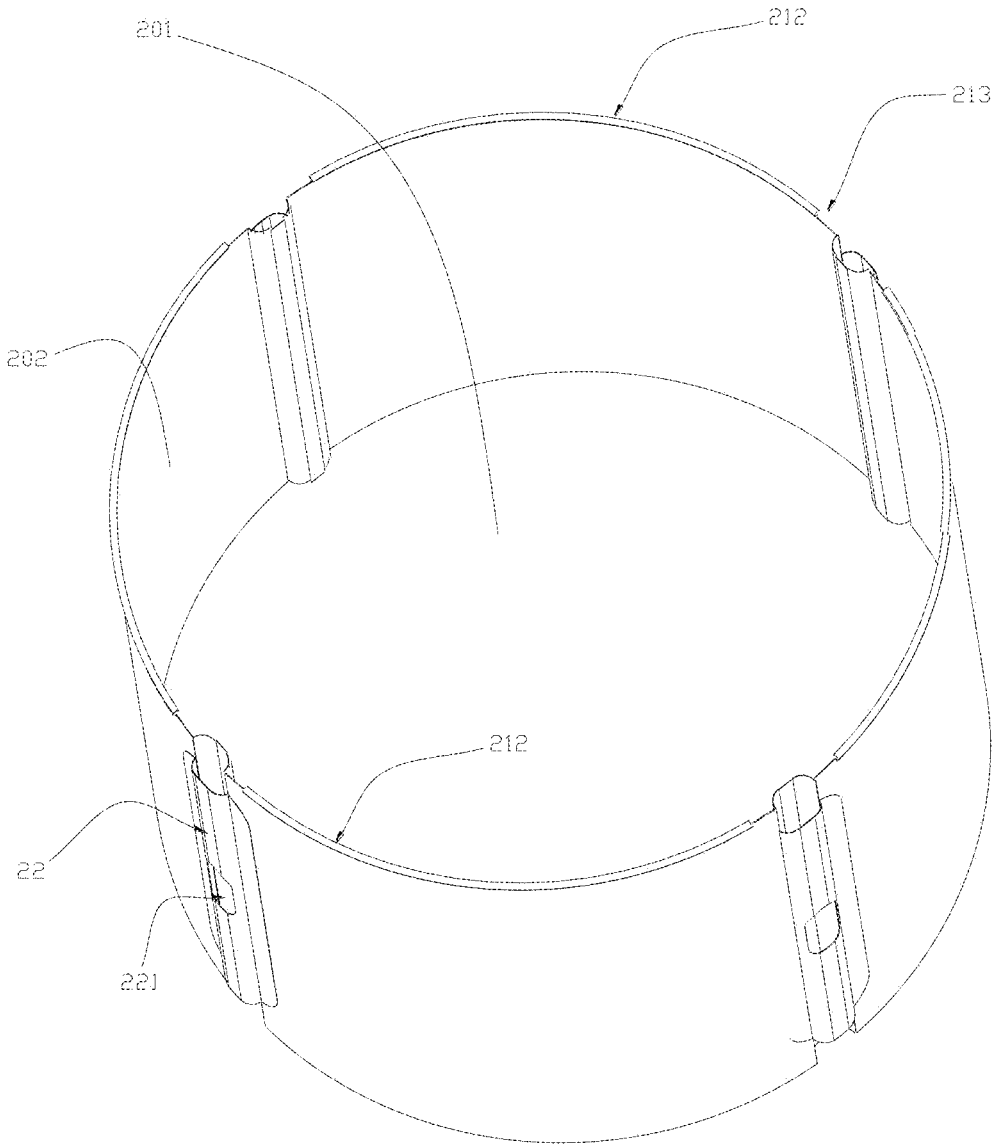
Figure 4:
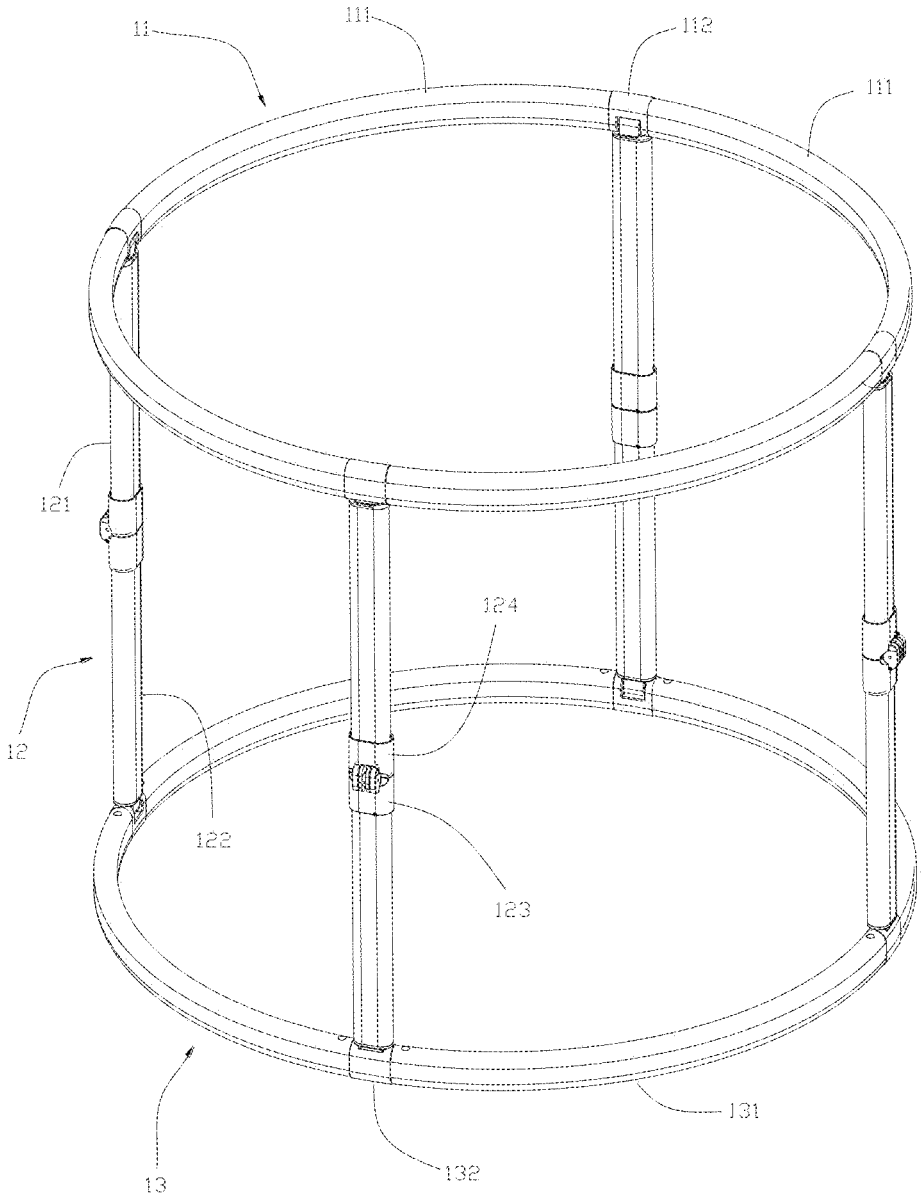
Figure 5:
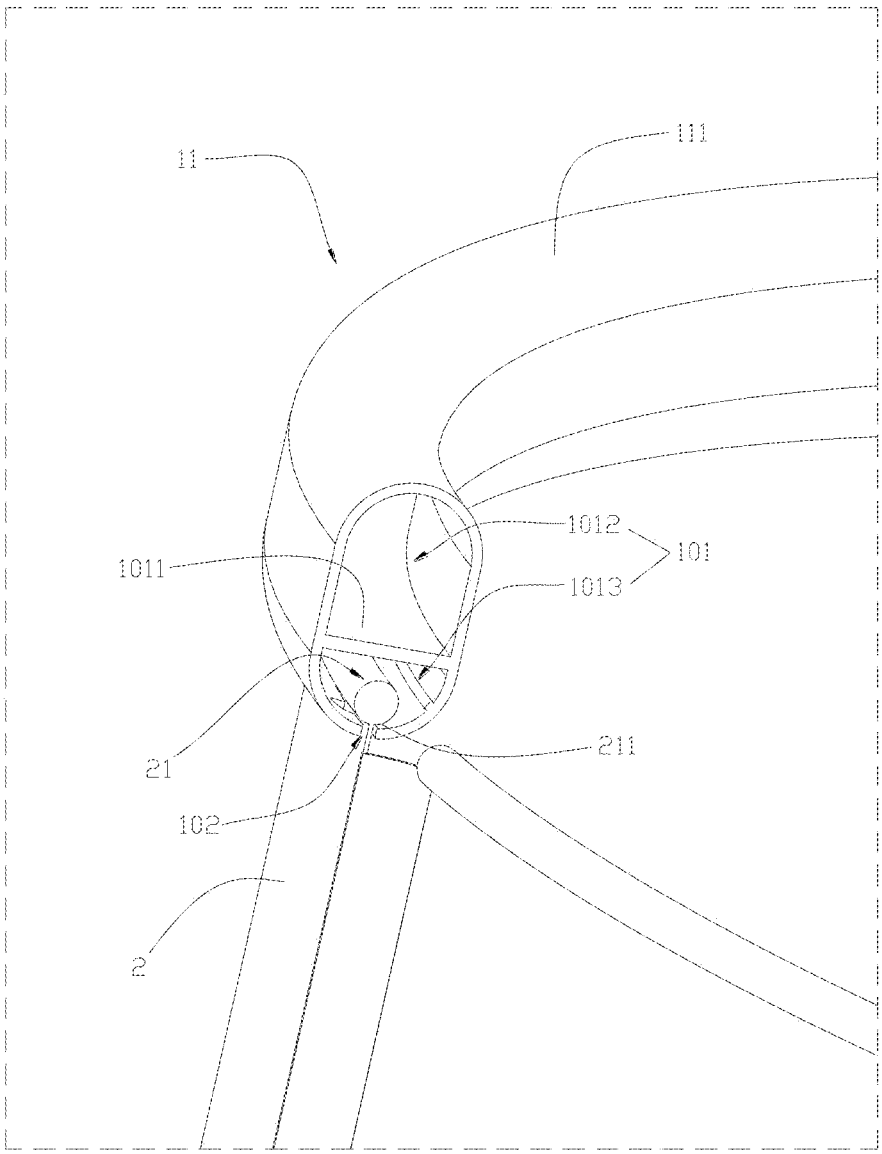
Figure 6:
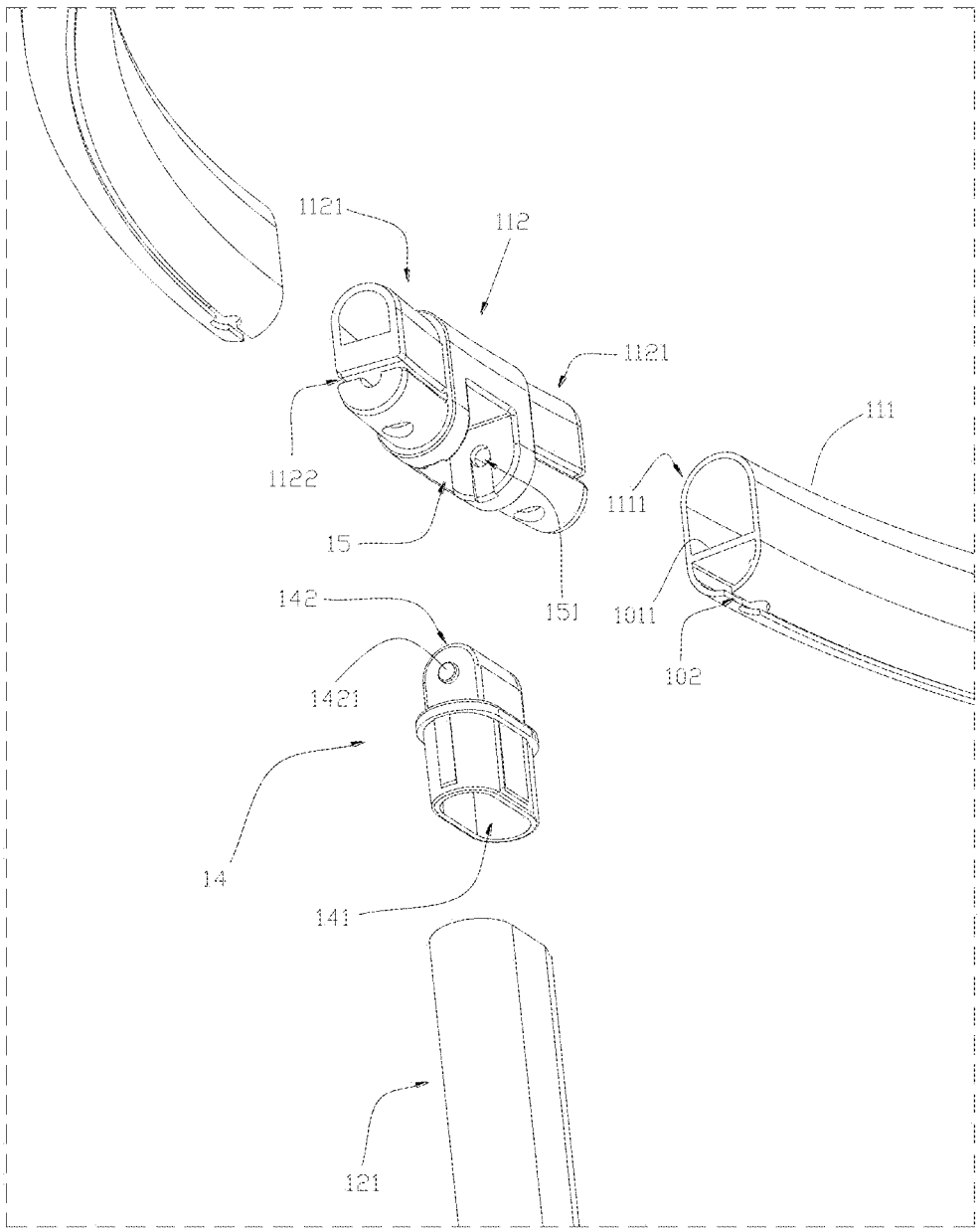
Figure 7:
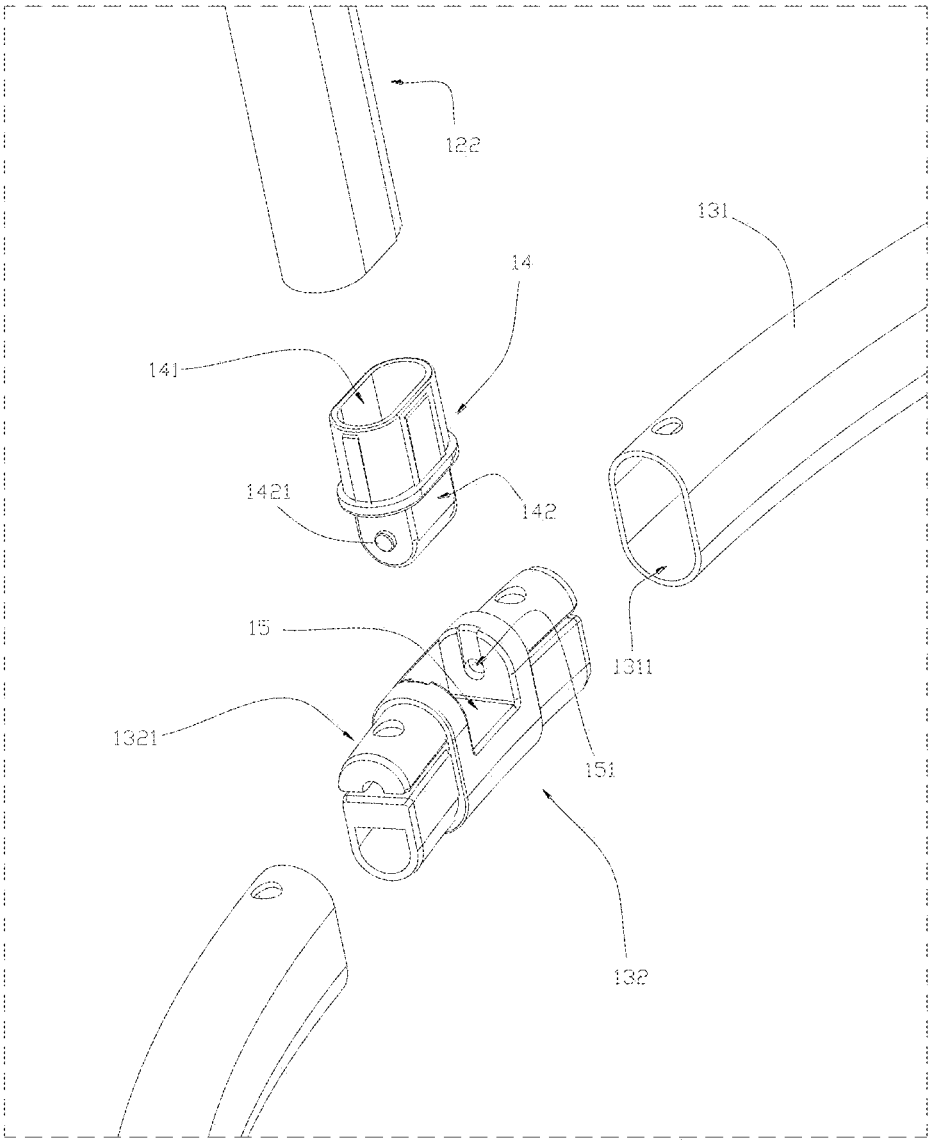
Figure 8:
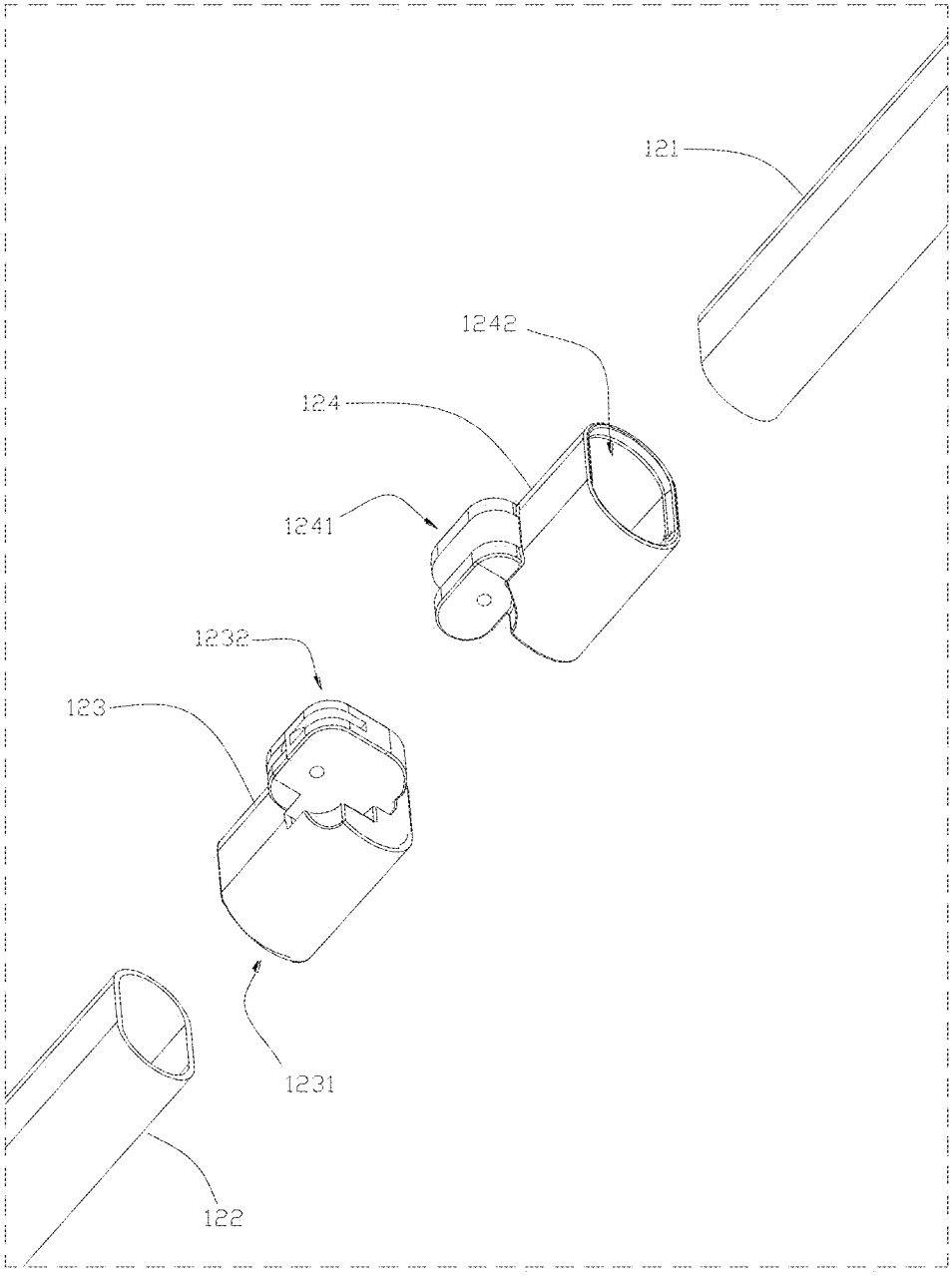

FIG. 1 is a three-dimensional state diagram after a folding bracket and a water storage component are connected;

FIG. 2 is a partially enlarged diagram of part A;

FIG. 3 is a three-dimensional state diagram of a water storage component;

FIG. 4 is a three-dimensional state diagram of a folding bracket;

FIG. 5 is a state diagram of clamping between a connection portion and a chamber;

FIG. 6 is a diagram of a connection relationship between a connection frame and a supporting rod;

FIG. 7 is a diagram of a connection relationship between a supporting rod and a bottom frame; and FIG. 8 is a diagram of a connection relationship between an upper supporting rod and a lower supporting rod.

DETAILED DESCRIPTION OF THE INVENTION

As shown in FIG. 1 to FIG. 8, the present disclosure provides a novel folding bath bucket, including a folding bracket 1 and a water storage component 2. The water storage component 2 is connected to the folding bracket 1 to form a bath bucket. The water storage component 2 includes a bottom wall 201 and a side wall 202; the side wall 202 is arranged around the bottom wall 201 to form a water storage space 203 for water storage. In this embodiment, the water storage component 2 is made of a flexible thermal insulation material.

Further, as a connection manner for the water storage component 2 and the folding bracket 1, a connection frame 11 is arranged at a top of the folding bracket 1; a chamber 101 is formed inside the connection frame 11; the chamber 101 forms a connection slot 102 at a bottom of the connection frame 11; a connection portion 21 is arranged at a top of the side wall 202 of the water storage component in a protruding manner; and the connection portion 21 is clamped in the chamber 101 through the connection slot 102 to achieve the connection between the water storage component 2 and the folding bracket 1.

It can be understood that in the present disclosure, the chamber 101 is arranged in the connection frame 11; the chamber 101 is communicated to the outside through the connection slot 102 at the bottom of the connection frame 11. To mount the water storage component 2, the side wall 202 can be continuously inserted into the connection slot 102 at one end of the connection frame 11 to achieve sliding mounting of the connection portion 21 in the chamber 101. Through the above arrangement, the connection portion 21 of the present disclosure is completely wrapped in the chamber 101 inside the connection frame 11, avoiding damage caused by direct contact between the connection portion 21 and the outside. This solves the technical problem that "in the existing folding bath bucket, a thermal insulation fabric is easily damaged during use because it sleeves a bucket opening connection sleeve" and prolongs the service life of the folding bath bucket. Furthermore, the folding bath bucket has a simple structure and is convenient to mount.

Further, in this embodiment, a thickness of the side wall 202 matches a width of the connection slot 102, so that the side wall 202 can conveniently pass through the connection slot 102. A cross-sectional diameter of the connection portion 21 is greater than the width of the connection slot 102, to prevent the connection portion 21 from falling off from the connection slot 102 and ensure that the connection portion 21 is clamped in the chamber 101. Specifically, the connection portion 21 is columnar, which is made of an elastic material. Limiting portions 211 are formed on two sides of the connection portion 21; and the limiting portions 211 resist against an inner wall of the chamber 101 to achieve the clamping between the connection portion 21 and the chamber 101.

Further, in this embodiment, a partition plate 1011 is further arranged in the chamber 101; the partition plate 1011 divides the chamber 101 into an upper chamber 1012 and a lower chamber 1013; and the connection portion 21 is clamped in the lower chamber 1013. Through the above arrangement, the partition plate 1011 can be configured to restrict displacement of the connection portion 21 in the chamber 101 in a vertical direction, so as to facilitate the sliding mounting of the connection portion 21 in the lower chamber 1013.

Further, in this embodiment, the connection frame 11 includes several first sleeves 111 and several first connectors 112; and adjacent first sleeves 111 are connected end to end through the first connectors 112. Specifically, first insertion portions 1121 are formed at two ends of the first connectors 112; first insertion ports 1111 are formed in the upper chamber 1012 at two ends of the first sleeves 111; insertion slots 1122 are further provided at two ends of the first connectors 112; and the partition plate 1011 extends to the two ends of the first sleeves 111.

Through the above arrangement, to assemble the connection frame 11, the first insertion portion 1121 and insertion slot 1122 at one end of each first connector 112 are respectively in inserted connection with the first insertion port 1111 at one end of one first sleeve 111 and the partition plate 1011, and the first insertion portion 1121 and insertion slot 1122 at the other end of the first connector 112 are respectively in inserted connection with the first insertion port 1111 at one end of another first sleeve 111 and the partition plate 1011. The above step is repeated to achieve end-to-end connection of the various adjacent first sleeves 111.

Further, in this embodiment, as a preference, the connection portion 21 includes several connection units 212; the connection units 212 are connected to the first sleeves 111; and two adjacent connection units 212 form a first avoidance opening 213 at the first connector 112. The first avoidance opening 213 is configured to avoid blockage of the water storage component 2 on the first insertion portions 1121, so as to ensure successful insertion of the first insertion portions 1121 into the first insertion ports 1111.

Further, in this embodiment, the folding bracket 1 further includes supporting rods 12 and a bottom frame 13; lower ends of the supporting rods 12 are detachably connected to the bottom frame 13; and upper ends of the supporting rods 12 are detachably connected to the first connectors 112. Similar to the connection frame 11, the bottom frame 13 includes several second sleeves 131 and several second connectors 132; and adjacent second sleeves 131 are connected end to end through the second connectors 132. Second insertion portions 1321 are formed at two ends of the second connectors 132; second insertion ports 1311 are provided at two ends of the second sleeves 131; and the second insertion portions 1321 are in inserted connection with the second insertion ports 1311.

Through the above arrangement, the connection frame 11 and the bottom frame 13 of the present disclosure can include the first sleeves 111, the second sleeves 131, the first connectors 112, and the second connectors 132, so as to further reduce the volume of the folding bracket 1.

Further, in this embodiment, as a connection manner for the supporting rods 12 and the connection frame 11, as well as the bottom frame 13, the folding bracket 1 further includes several third connectors 14; and two ends of the supporting rods 12 are respectively connected to the first connectors 112 and the second connectors 132 through the third connectors 14. Specifically, a third insertion port 141 is provided at one end of each third connector 14, and a protrusion 142 is arranged at the other end; the first connectors 112 and the second connectors 132 include connection ports 15; the two ends of the supporting rods 12 are respectively connected to the third insertion ports 141; and the protrusions 142 are connected to the connection ports 15.

Further, in this embodiment, as a connection manner for the protrusions 142 and the connection ports 15, first insertion units 1421 are arranged on two sides of the protrusions 142 in a raised manner; second insertion units 151 are correspondingly arranged on inner side walls of the connection ports 15 in a recessed manner; and the first insertion units 1421 are in inserted connection with the second insertion units, so as to achieve the connection between the protrusions 142 and the connection ports 15.

Further, in this embodiment, each supporting rod 12 includes an upper supporting rod 121 and a lower supporting rod 122; and a lower end of the upper supporting rod 121 is in folded connection with an upper end of the lower supporting rod 122. Through the above arrangement, a user can apply an inwards thrust to a folded connection part, so as to inwards fold the upper supporting rod 121 and the lower supporting rod 122.

Further, to ensure that the upper supporting rod 121 and the lower supporting rod 122 are folded in half, in this embodiment, the upper supporting rod 121 has a length equal to a length of the lower supporting rod 122, and the length is $R_1$; a cross-sectional diameter of the folding bracket 1 is $R_2$; and $R_1$ and $R_2$ satisfy the following relationship: $R_1 \leq R_2/2$. Through the above arrangement, $R_1 \leq R_2/2$ can ensure that after all the supporting rods 12 are folded in half, the folding points will not block each other.

Further, in this embodiment, each supporting rod 12 further includes a first hinge piece 123 and a second hinge piece 124; a lower supporting rod insertion port 1231 is provided at a lower end of the first hinge piece 123, and a first hinge portion 1232 is arranged at an upper end of the first hinge piece; a second hinge portion 1241 is arranged at a lower end of the second hinge piece 124, and an upper supporting rod insertion port 1242 is provided at an upper end of the second hinge piece; the upper supporting rod insertion port 1242 and the lower supporting rod insertion port 1231 are respectively connected to the upper supporting rod 121 and the lower supporting rod 122; and the first hinge portion 1232 is hinged with the second hinge portion 1241, so as to achieve the folded connection between the upper supporting rod 121 and the lower supporting rod 122.

Through the above arrangement, the folding bracket 1 of the present disclosure can include the first sleeves 111, the second sleeves 131, the first connectors 112, the second connectors 132, the upper supporting rods 121, the lower supporting rods 122, the first hinge piece pieces 123, and the second hinge piece pieces 124, which greatly reduces the overall volume of the folding bracket 1, facilitates the assembling and disassembling, and solves the technical problem that "the existing folding bath bucket still occupies a large space after being folded".

Further, in this embodiment, the water storage component 2 further includes a sleeving portion 22; the sleeving portion 22 is arranged in an extension direction of the supporting rods 12 to sleeve the supporting rods 12. Each sleeving portion 22 is provided with a second avoidance opening 221 at a connection between the upper supporting rod 121 and the lower supporting rod 122. The first hinge piece 123 and the second hinge piece 124 can pass through the second avoidance opening 221. Through the above arrangement, to mount the water storage component 2, the supporting rods can be first inserted into the sleeving portions 22, and then all the connection units 212 are clamped into the corresponding first sleeves 111 to achieve the mounting of the water storage component 2. The operation is simple, and the assembling and disassembling are convenient.

As described above, one or more embodiments are provided in conjunction with the detailed description, The specific implementation of the present disclosure is not confirmed to be limited to that the description is similar to or similar to the method, the structure and the like of the present disclosure, or a plurality of technical deductions or substitutions are made on the premise of the conception of the present disclosure to be regarded as the protection of the present disclosure.

The invention claimed is:

1. A novel folding bath bucket, comprising a folding bracket and a water storage component, wherein the water storage component is connected to the folding bracket for water storage; a connection frame is arranged at a top of the folding bracket; a chamber is formed inside the connection frame; the chamber forms a connection slot at a bottom of the connection frame; a connection portion is arranged at a top of the water storage component; and the connection portion is clamped in the chamber through the connection slot to achieve the connection between the water storage component and the folding bracket;

wherein a partition plate is further arranged in the chamber; the partition plate divides the chamber into an upper chamber and a lower chamber; and the connection portion is clamped in the lower chamber.

2. The novel folding bath bucket according to claim 1, wherein the water storage component comprises a bottom wall and a side wall; the side wall is arranged around the bottom wall to form a water storage space; and the connection portion protrudes out of a top of the side wall.

3. The novel folding bath bucket according to claim 2, wherein a thickness of the side wall matches a width of the connection slot; and a cross-sectional diameter of the connection portion is greater than the width of the connection slot.

4. The novel folding bath bucket according to claim 3, wherein limiting portions are formed on two sides of the connection portion; and the limiting portions resist against an inner wall of the chamber to achieve the clamping between the connection portion and the chamber.

5. The novel folding bath bucket according to claim 1, wherein the connection frame comprises several first sleeves and several first connectors; and adjacent first sleeves are connected end to end through the first connectors.

6. The novel folding bath bucket according to claim 5, wherein first insertion portions are formed at two ends of the first connectors; first insertion ports are formed in the chamber at two ends of the first sleeves; and the first insertion portions are in inserted connection with the first insertion ports.

7. The novel folding bath bucket according to claim 6, wherein insertion slots are further provided at two ends of the first connectors; the partition plate extends to the two ends of the first sleeves; and the partition plate is in inserted connection with the insertion slots.

8. The novel folding bath bucket according to claim 7, wherein the connection portion comprises several connection units; the connection units are connected to the first sleeves; and two adjacent connection units form a first avoidance opening at the first connector.

9. The novel folding bath bucket according to claim 7, wherein the folding bracket further comprises supporting rods and a bottom frame; lower ends of the supporting rods are detachably connected to the bottom frame; and upper ends of the supporting rods are detachably connected to the first connectors.

10. The novel folding bath bucket according to claim 9, wherein the bottom frame comprises several second sleeves and several second connectors; and adjacent second sleeves are connected end to end through the second connectors.

11. The novel folding bath bucket according to claim 10, wherein second insertion portions are formed at two ends of the second connectors;

second insertion ports are provided at two ends of the second sleeves; and the second insertion portions are in inserted connection with the second insertion ports.

12. The novel folding bath bucket according to claim 11, wherein the folding bracket further comprises several third connectors; and two ends of the supporting rods are respectively connected to the first connectors and the second connectors through the third connectors.

13. The novel folding bath bucket according to claim 12, wherein a third insertion port is provided at one end of each third connector, and a protrusion is arranged at the other end; the first connectors and the second connectors comprise connection ports; the two ends of the supporting rods are respectively connected to the third insertion ports; and the protrusions are connected to the connection ports.

14. The novel folding bath bucket according to claim 13, wherein first insertion units are arranged on two sides of the protrusions; second insertion units are correspondingly arranged on inner side walls of the connection ports;

and the first insertion units are in inserted connection with the second insertion units.

15. The novel folding bath bucket according to claim 9, wherein each supporting rod comprises an upper supporting rod and a lower supporting rod;

and a lower end of the upper supporting rod is in folded connection with an upper end of the lower supporting rod.

16. The novel folding bath bucket according to claim 15, wherein each supporting rod further comprises a first hinge piece and a second hinge piece;

a lower supporting rod insertion port is provided at a lower end of the first hinge, and a first hinge portion is arranged at an upper end of the first hinge piece; a second hinge portion is arranged at a lower end of the second hinge, and an upper supporting rod insertion port is provided at an upper end of the second hinge piece; the upper supporting rod insertion port and the lower supporting rod insertion port are respectively connected to the upper supporting rod and the lower supporting rod; and the first hinge portion is hinged with the second hinge portion.

17. The novel folding bath bucket according to claim 16, wherein the water storage component further comprises a sleeving portion; the sleeving portion is arranged in an extension direction of the supporting rods to sleeve the supporting rods.

18. The novel folding bath bucket according to claim 17, wherein the sleeving portion is provided with a second avoidance opening at a connection between the upper supporting rod and the lower supporting rod.

19. The novel folding bath bucket according to claim 15, wherein the upper supporting rod has a length equal to a length of the lower supporting rod, and the length is $R_1$; a cross-sectional diameter of the folding bracket is $R_2$; and $R_1$ and $R_2$ satisfy the following relationship: $R_1 \leq R_2/2$.

* * * * *